United States Patent [19]

Brockett

[11] 4,303,245

[45] Dec. 1, 1981

[54] GOLF SWING TEACHING AID

[76] Inventor: Charles V. Brockett, 22825 Brenford, Woodland Hills, Calif. 91364

[21] Appl. No.: 142,693

[22] Filed: Apr. 22, 1980

[51] Int. Cl.[3] ..... A63B 69/36

[52] U.S. Cl. ..... 273/185 R; 273/181 A; 434/252; 160/351

[58] Field of Search ..... 273/185 R, 181 R, 181 A, 273/181 K, 181 F, 176 A, 26 A, 181 J, 190, 354, 402; 52/63, 146; 160/135, 351, 350; 434/252; 272/22, 101

[56] References Cited

U.S. PATENT DOCUMENTS

| | | | |
|---|---|---|---|
| 420,668 | 2/1890 | Wallace | 160/135 X |
| 1,142,184 | 6/1915 | Lawrence | 273/26 A |
| 1,592,005 | 7/1926 | Rovane | 273/26 A |
| 1,629,907 | 5/1927 | Dwyer | 273/181 A |
| 1,719,240 | 7/1929 | Scanlan | 273/181 A X |
| 1,745,201 | 1/1930 | Alston | 273/181 R |
| 2,378,935 | 6/1945 | Kraft | 160/351 X |
| 2,879,553 | 3/1959 | Keating | 52/63 X |
| 3,178,181 | 4/1965 | Burnett et al. | 160/351 X |
| 3,687,457 | 8/1972 | Mason et al. | 273/185 R X |
| 3,810,616 | 5/1974 | Murphy | 273/181 A X |
| 3,904,209 | 9/1975 | Thomas | 273/176 A |

*Primary Examiner*—George J. Marlo
*Attorney, Agent, or Firm*—Martin R. Horn

[57] ABSTRACT

A golf swing teaching aid device comprising a vertical free standing screen with an open space in its lower, middle area is disclosed. The device is tall enough and wide enough to block the golfer's view of the flight of the golf ball, yet the open, center space allows the ball to pass through the device in its normal trajectory. The device may include a flap for adjusting the dimensions of the open, center space or for stopping the ball within the center space rather than allowing passage. The screen may be made of an impact absorbing and impressionable material such as vinyl coated nylon, which is temporarily marked when struck by a golf ball.

8 Claims, 6 Drawing Figures

Fig. 1
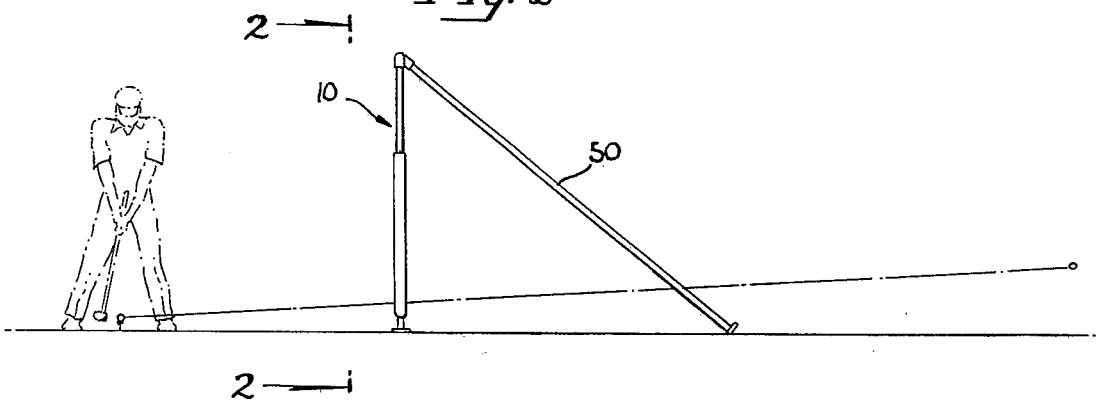
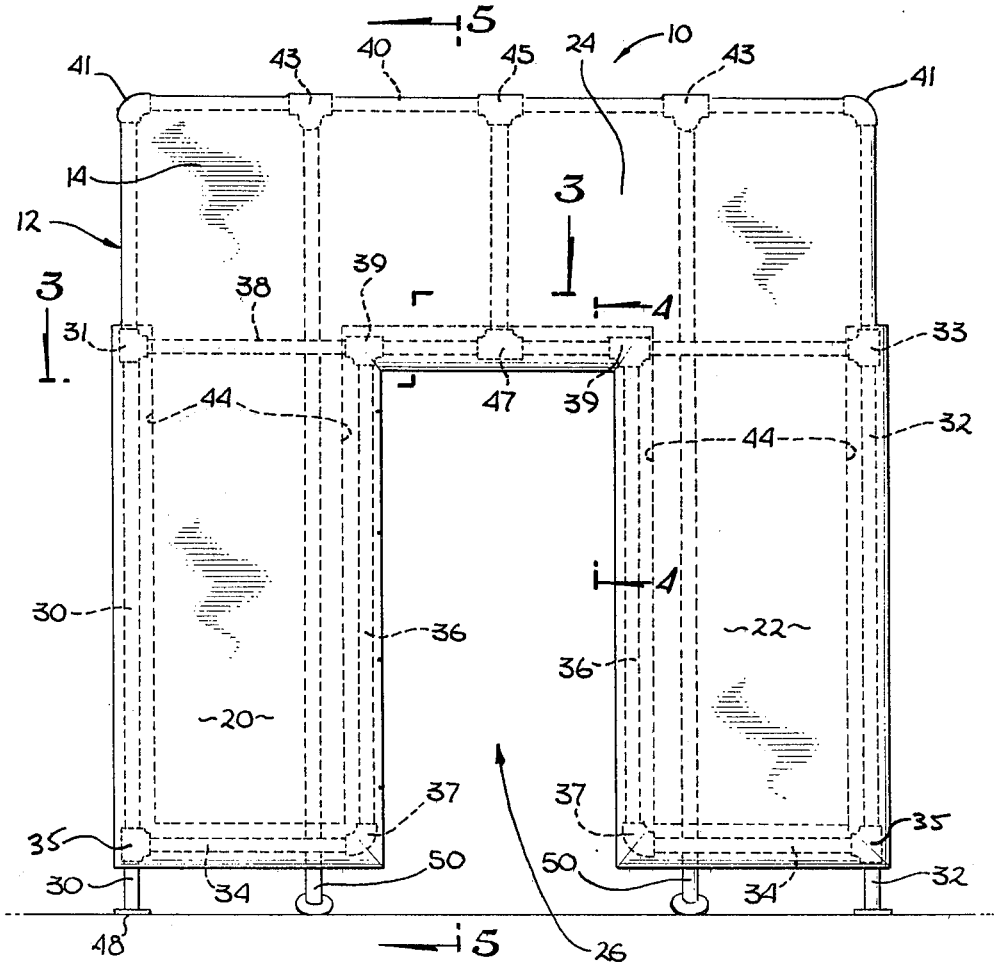
Fig. 2

GOLF SWING TEACHING AID

BACKGROUND OF THE INVENTION

1. Field of the Invention

This invention relates to golf swing teaching aid devices, specifically to devices which block a golfer's view of the flight of a struck golf ball but allow the normal flight of the ball to be viewed by an instructor.

2. Prior Art

There are a wide variety of devices available to aid a golfer in practicing his golf swing. One such teaching aid is the golf driving net. With this device, the golfer hits the ball into a net a few feet in front of him. This device allows the golfer to practice his swing yet avoids the dangers possible by allowing the struck balls to continue their normal flight. One drawback to this device is that the golfer's view of the flight of the ball is not blocked. It is well known that one of the most serious problems in perfecting a golf swing is the tendency of the golfer to prematurely look up during the swing to follow the flight of the ball. This looking up will cause basic errors in the swing. The golf driving net does not alleviate this problem significantly. The golfer will still be tempted to watch the flight of the ball as it enters the net. In addition, since the net catches the ball after a flight of only a few feet, it is impossible for an instructor to determine the exact direction, i.e., hook or slice, or trajectory of the shot, or the distance the ball would have travelled.

Another teaching aid is an electronic device that measures the club head speed and direction at the point of impact to calculate the distance and flight direction of the ball. However, if this device is used on a driving range, it does not eliminate the tendency of the golfer to view the flight of the ball. If the device is used with a golf driving net, the ball is not allowed to travel its normal path and there still is no blocking of the vision of the golfer. In addition, such a device is too expensive for the average golf instructor to own and operate.

A third teaching aid allows the instructor to video record the golfer's swing and to play it back for the golfer's viewing. This device does not address the problem of blocking the view of the golfer while allowing the instructor to see the complete flight path of the ball. This device is also quite expensive to own and operate.

Thus, there are no devices presently available which are designed to block the golfer's view of the flight of the golf ball while allowing the instructor to view the complete flight of the ball.

Accordingly, it is the primary object of this invention to provide a device which blocks the lateral vision of a golfer to prevent him from viewing the flight of the struck golf ball, thereby reducing the tendency of the golfer to prematurely look up during the golf swing, while still allowing full vision of the ball at rest.

It is another object of this invention to provide a device which does not alter the natural flight of a struck golf ball, permitting the golf instructor to see the resulting distance and direction of the struck golf ball.

It is yet another object of this invention to provide a golf swing teaching aid device which is sufficiently inexpensive to own and operate to be affordable by the average golf instructor.

SUMMARY OF THE INVENTION

Most golfers are so visually oriented and so anxious to see where the golf ball is going that they prematurely look up during their swing, thereby causing basic errors in their swing. Because of this universal and fundamental problem, very few golfers are able to accurately predict the results of the shot without visual sighting. It has been found that the best method to produce a good, consistent golf swing is to concentrate solely on the elements of the swing to develop a feel for the shot, and not the resulting flight of the golf ball. However, this type of concentration and feel is difficult to achieve for most golfers because of their visual orientation. The present invention is designed to block the golfer's lateral vision and thereby prevent him from visually following the flight of the golf ball, yet allowing the instructor to see the results of the golf swing, namely, the flight of the ball.

One embodiment of the present invention includes a large opaque screen which is placed vertically to the side of the golfer and perpendicular to the flight of the ball. In the lower center portion of the screen is a cut out area large enough so that a properly hit golf ball will pass through the screen and continue its normal flight. The open area extends only high enough up to allow the passage of the golf ball, but not high enough to allow the golfer to see through the opening. When the golfer addresses the ball he positions himself a short distance behind the screen with the ball directly behind the opening. When the ball is struck correctly, it will travel through this opening in the screen and outward in its normal path. Should the ball be struck significantly to the right or left of center it will hit the screen. The screen is designed to absorb the force of the impact, causing the ball to fall harmlessly downward.

The dimensions of the opening in the screen, both height and width, may be adjusted depending on the requirements of the golfer and/or the club which is being used. It is possible, also, to adapt the device to be used without an instructor. One such embodiment covers the opening with pockets of a resilient material. The pocket ensnaring the ball will indicate the expected flight distance or direction of the ball. Another embodiment has a single flap which may be adjusted to cover any or all portions of the opening, allowing use of the invention as a net when a golfer wishes to practice alone.

BRIEF DESCRIPTION OF THE DRAWINGS

FIG. 1 is a side plan view of one embodiment of the inventive golf swing teaching aid device;

FIG. 2 is a front plan view of the embodiment of FIG. 1;

DETAILED DESCRIPTION OF PREFERRED EMBODIMENTS

Figure 3:
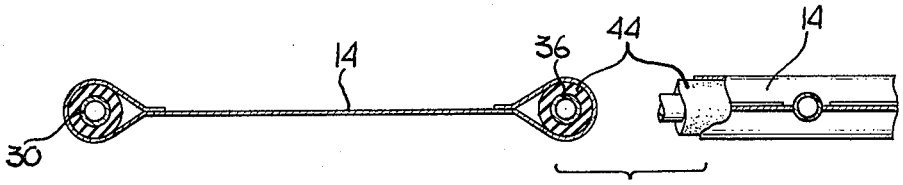
FIG. 3 is a cross sectional view, taken along lines 3—3, of FIG. 2.

FIGS. 1 through 5 illustrate a preferred embodiment of the inventive golf swing teaching aid device 10. The device 10 includes a frame 12 over which is placed an opaque resilient material 14. The device 10 is divided into essentially four sections: a left screen 20, a right screen 22, a top screen 24, and a center space 26. In the preferred embodiments the screens 20, 22, and 24 are unitary.

The sides of the center space 26 are defined by inner poles 36. Attached to the inner poles 36 by brackets 37 are two bottom cross-members 34. These bottom cross-members 34 extend outwardly from the center space 26, and are collinear and perpendicular to the inner poles 36. A left pole 30 and a right pole 32 are attached to opposite ends of the bottom cross member 34 by brackets 35. They extend upwardly, perpendicular to the bottom cross-members 34 and parallel to the inner poles 36. A middle cross-member 38 extends perpendicular to the inner poles 36 and the right 32 and left 30 poles, and parallel to the bottom cross-members 34. One end of the middle cross-member 38 is attached to the left pole 30 at bracket 31 and the other end is attached to the right pole 32 at bracket 33. The attachment points are at the same height as the tops of inner poles 36. The top ends of the inner poles 36 are attached to the middle cross-member 38 by brackets 39. Left pole 30, along with bottom cross number 34, inner pole 36, and middle cross-member 38, define the perimeter of the right screen 22. The inner poles 36 are approximately two feet apart and, in conjunction with the center section of the middle cross number 38, define the sides and top of center space 26. In the preferred embodiment, the inner poles 36 are approximately four feet in height so that the center space 26 is approximately two feet wide by four feet high.

The left pole and the right pole 32 extend upwardly beyond their junction 31, 33, with the middle cross-member 38. A top cross-member 40 is positioned between the left pole and the right pole 32. It is attached by brackets 41 to the tops of the left 30 and right 32 poles. Attached at approximately the center point of the top cross-member 40 by bracket 45 is center pole 42, which extends perpendicular from the top cross-member 40 down to the approximate center point of the middle cross-member 38, to which it is attached by bracket 47. The top thirds of the left pole 30 and the right pole 32, along with the top cross number 40 and the middle cross-member 38 define the perimeter of the top screen 24.

In one embodiment, padding 44 is placed around inner poles 36, bottom cross-member 34, the center section of the middle cross-member 38 and the bottom two thirds of the left pole 30 and the right pole 32. The padding 44 is a soft, resilient material such as foam rubber so that a golf ball which strikes the padded members will drop harmlessly to the ground rather than ricochet dangerously back at the golfer or the instructor. Of course, padding may also be placed on other exposed pole areas which tend to be struck by the golf balls.

The entire interior areas of the left screen 20, the right screen 22 and the top screen 24 are covered by a resilient, opaque material 14, such as vinyl or canvas. It is secured, such as by lacing or adhesive to the poles along its perimeter. In one embodiment an 18 oz. vinly coated nylon was used. This material is advantageous since it is temporarily "pocketmarked" by a golf ball it stops. This allows the golfer to determine after he has completed his swing where on the screen the ball was stopped.

In order to assist the golf instructor in visually estimating where a struck golf ball passes through the opening 26, one embodiment of the invention includes ruler markings 64 (shown in FIG. 6) on the material 14 along the edges of screens defining the perimeter of the opening 26. Such markings 64 help the instructor estimate the height of the shot as it passes through the opening 26 and the consistency of a golfer's swing.

In the embodiment illustrated in FIG. 1, the center space 26 has no covering and is open, allowing golf balls to pass freely through it. Extending downwardly from and attached to the left pole 30 and the right pole 32 are feet 48 upon which the entire device 10 may rest. The device 10 is supported in substantially a vertical position by braces 50 which extend downwardly and outwardly from brackets 43 along the top cross-member 40. The other ends of these braces 50 rest on the ground.

In operation, the device 10 is placed in a generally vertical position with the braces 50 supporting the device 10. The golfer positions himself on the side of the device 10 opposite the braces 50, with the ball approximately three to eight feet behind the center of the center space 26 depending on the type of club the golfer is using. Generally, if the opening 26 is two feet by four feet, when the golfer is using a short iron, he will stand about three feet from the screen, whereas if he is using a driver, he will stand six to eight feet away.

The golfer positions himself such that a correctly hit golf ball will exit through the center of the center space 26. Thus, an instructor, standing to one side, will be able to follow the flight of a correctly hit golf ball. However, should the ball be hit to the left or right of center, the ball will hit either the padding 44 or the opaque resilient material 14, and fall harmlessly to the ground. Since the material 14 covering the screens 20, 22, and 24 is opaque and the device 10 is large enough to block the golfer's vision, the golfer will be able to see the flight of his golf ball once it passes the device 10 and thus will not be tempted to look up prematurely, thereby improving his golf swing.

Depending on the requirements of the golfer using the device 10 and the club being used by the golfer, it may be desired to adjust the dimensions of the center space 26. For this purpose, it is possible to attach an extra flap of material along the middle cross-member 38. The flap may be rolled down to cover a portion of the center space 26 and thereby reduce its height. Strings may be attached to the bottom corners of the flap so that it may be secured to the inner poles 36. Similarly, a flap of material, attached along either of the inner poles 36, may be rolled inward, thereby covering a side portion of the center space 26 and tied to the middle cross-member 38 to reduce the width of the center space 26.

Figure 4:
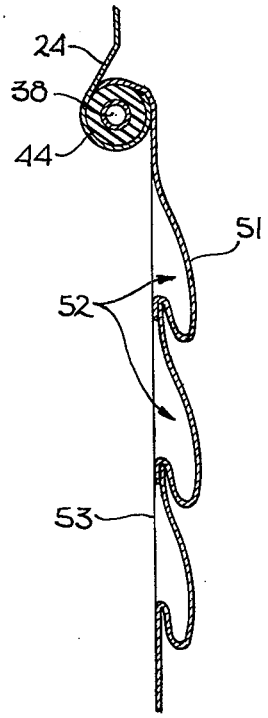
FIG. 4 is a sectional view, taken along lines 4—4 of FIG. 2, of a flap which may be optionally included with the embodiment of FIG. 2 to provide a set of pockets which will ensnare properly struck golf balls.
Figure 5:
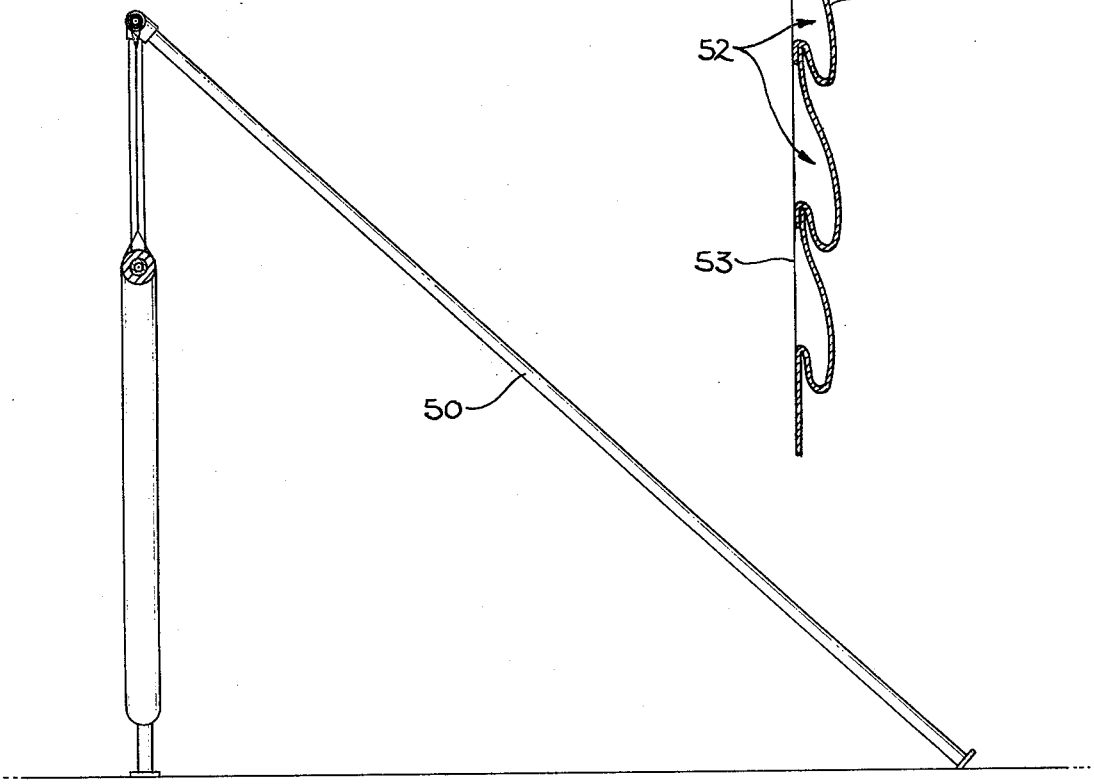
FIG. 5 is a sectional view, taken along lines 5—5 of FIG. 2.

FIG. 4 illustrates a variation on the preferred embodiment illustrated in FIG. 2. A flap 51 is attached to the middle cross-member covering the opening 26. The flap 51 includes several pockets 52. The flap 51 may be made of material similar to the screens 20, 22, 24 or any other flexible material which can absorb the impact of a struck golf ball. The purpose of the pockets 52 is to ensnare golf balls which would otherwise pass through the opening 26. A golfer may determine the approximate course of a properly struck golf ball by determining which pocket 52 ensnared the golf ball.

The pockets 52 may be formed by gathering together the material of the flap 51. This gathering may be done by several cords 53 vertically spaced across the width of the flap 51.

The principal advantage to having such a flap 51 is that the device 10 may be used in conjunction with a golf instructor by rolling up the flap 51 to form the opening 26. However, if there is no golf instructor present, the golfer may roll the flap 51 down across the opening 26 and use the device 10 as a driving net. The pockets 52 will allow him to determine the approximate path a properly struck golf ball was taking.

Figure 6:
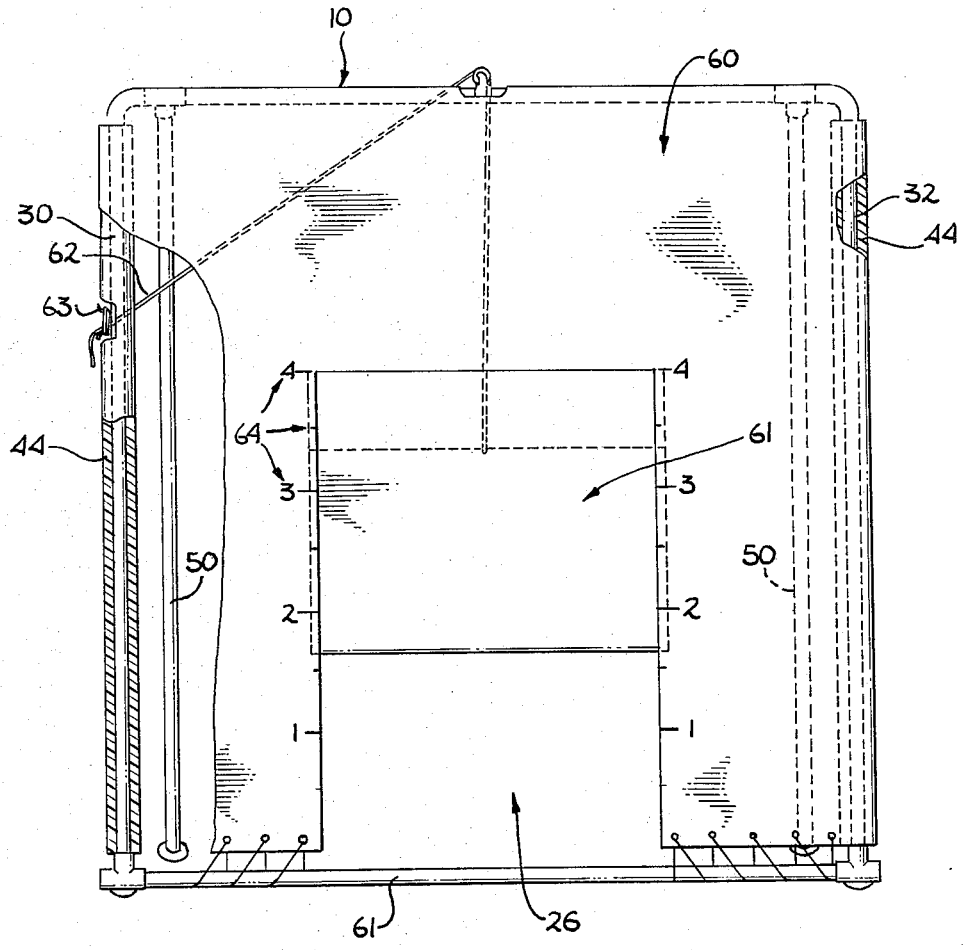
FIG. 6 is a front plan view, partially broken away of an alternate embodiment of the invention.

FIG. 6 is a front plan view of another preferred embodiment of the invention. In contrast to the embodiment illustrated in FIG. 2, the opening 26 of the screen 60 is not supported by a frame. Accordingly, padding 44 need only be placed around the lower portions of the left 30 and right 32 poles. A single bottom/cross-member 61 is attached between the left 30 and right poles 32 at ground level. The screen 60 may be laced or otherwise fastened to the bottom cross-member 61. The screen 60 illustrated in FIG. 6 is unitary, with an adjustable flap 61. The flap 61 may be raised or lowered via a rope 62. The rope 62 is secured to a cleat 63 to maintain the height of the opening 26. The embodiment illustrated in FIG. 6 does not include pockets in the flap 61. Accordingly, a golf ball striking the flap 61 will drop to the ground in front of the apparatus 10.

A portion of the screen 60 is cut away in FIG. 6 to show the padding 44, brace 50, and left cross-member 30.

While a wide variety of materials, shapes and other other configurations can be used in this invention, it should be understood that such changes can be made without departing from the spirit or scope thereof. For example, in the preferred embodiment, the shape of the device 10 as well as the shape of the center space 26 is generally rectangular. These shapes may be altered in any way to suit the user thereof, such as by reducing the opening size or making the center space generally semicircular, while retaining the general benefits described above. This invention, therefore, is not to be limited to the specific embodiments discussed and illustrated herein.

What is claimed is:

1. A golf swing teaching aid device to be placed between a golfer and a golf course or driving range, comprising:

a free standing opaque screen of generally inverted U-shape, having an opening therethrough at the bottom thereof and including means for absorbing the force of impact of golf balls to cause impacting golf balls to fall harmlessly downward, wherein said opaque screen and said opening are conconfigured to allow the passage of struck golf balls completely therethrough and thereby permit the normal flight thereof, and further wherein said opaque screen is configured to completely block the view of said golfer of the flight of the struck golf ball.

2. A device according to claim 1 further comprising an outer, generally inverted U-shaped frame to which said screen is attached.

3. A device according to claim 2 further comprising padding, attached to portions of said frame, of sufficient resiliency to prevent the ricochet of misstruck golf balls which hit said frame.

4. A device according to claim 1 when said opaque screen is about 6.5 feet high and 6 feet wide.

5. A device according to claim 4 wherein said opening is about 4 feet high and 2 feet wide.

6. A device according to claim 1 wherein said opaque screen comprises an impressionable material which is temporarily marked when struck by a golf ball.

7. A device according to claim 6 wherein said material is a vinyl coated nylon.

8. A device according to claim 1 wherein said opaque screen has position markings adjacent said opening to allow a teacher or other observer to judge the point of passage of a struck golf ball through said opening.

* * * * *